US006808297B2

(12) United States Patent
Jensen et al.

(10) Patent No.: US 6,808,297 B2
(45) Date of Patent: Oct. 26, 2004

(54) DECORATIVE CANDLE LAMP

(75) Inventors: Bradford Brian Jensen, St. Joseph, MI (US); Roger Donn Bentley, Coloma, MI (US); Kim Irwin McCavit, St. Joseph, MI (US)

(73) Assignee: The Lamson & Sessions Co., Clevleland, OH (US)

( * ) Notice: Subject to any disclaimer, the term of this patent is extended or adjusted under 35 U.S.C. 154(b) by 38 days.

(21) Appl. No.: 10/022,693

(22) Filed: Dec. 17, 2001

(65) Prior Publication Data

US 2003/0081420 A1 May 1, 2003

Related U.S. Application Data

(60) Provisional application No. 60/335,587, filed on Oct. 31, 2001.

(51) Int. Cl.[7] ..... F21V 35/00

(52) U.S. Cl. ..... 362/392; 362/190; 362/810

(58) Field of Search ..... 362/190, 191, 362/392, 569, 800, 810, 441, 447, 205

(56) References Cited

U.S. PATENT DOCUMENTS

| | | | | | |
|---|---|---|---|---|---|
| 3,684,882 | A | * | 8/1972 | Mininno et al. | 362/392 |
| 4,617,614 | A | * | 10/1986 | Lederer | 362/392 |
| 4,866,580 | A | * | 9/1989 | Blackerby | 362/810 |
| 5,174,645 | A | * | 12/1992 | Chung | 362/810 |
| 6,241,362 | B1 | * | 6/2001 | Morrison | 362/392 |
| 6,341,882 | B1 | * | 1/2002 | Lin | 362/800 |
| 6,595,676 | B2 | * | 7/2003 | Starry | 362/569 |

* cited by examiner

*Primary Examiner*—Y. My Quach-Lee
*Assistant Examiner*—Peggy A. Neils
(74) *Attorney, Agent, or Firm*—Jones Day

(57) ABSTRACT

The present invention is an apparatus having a horizontally elongated base and a simulated candle projecting upward from the base. The base defines a horizontally elongated battery compartment. A pair of battery contacts are located in the battery compartment, and the compartment is configured to hold a row of batteries in end-to-end horizontal positions.

3 Claims, 3 Drawing Sheets

DECORATIVE CANDLE LAMP

This application claims priority of U.S. Provisional Application Ser. No. 60/335,587, filed Oct. 31, 2001.

FIELD OF THE INVENTION

The present invention relates to the field of electric lamps, and more particularly to candle-shaped lamps.

BACKGROUND OF THE INVENTION

Specialized electric lamps may be designed to look like wax candles. Such lamps are used in the home as decorative elements and are often placed on windowsills for display.

SUMMARY OF THE INVENTION

In accordance with a principal feature of the present invention, a lamp apparatus includes a vertically elongated, candle-shaped lamp structure including a battery powered source of light. The apparatus further includes a horizontally elongated base configured to support the lamp structure. The base defines a horizontally elongated battery compartment configured to receive batteries in a row in end-to-end horizontal positions, and includes battery contacts at opposite ends of the battery compartment.

In accordance with another principal feature of the invention, the candle-shaped lamp structure has a candlestick portion with a cylindrical side wall centered on an axis. A pair of opposed guide structures are located at an inner surface of the side wall. A vertically elongated circuit board is received upward through an upper lower end of the side wall, and has opposite vertical side edges received by the guide structures. In this arrangement, the circuit board divides the interior of the candlestick into two vertically elongated compartments on opposite sides of the circuit board. A source of light is electrically connected to the circuit board in a position located above an upper end edge of the circuit board, and is centered on the cylindrical axis. This enables light from the source to have an uninterrupted path from the source upward through an aperture at the upper end of the candlestick, and also downward through the compartments in the candlestick.

DESCRIPTION

Figure 1:
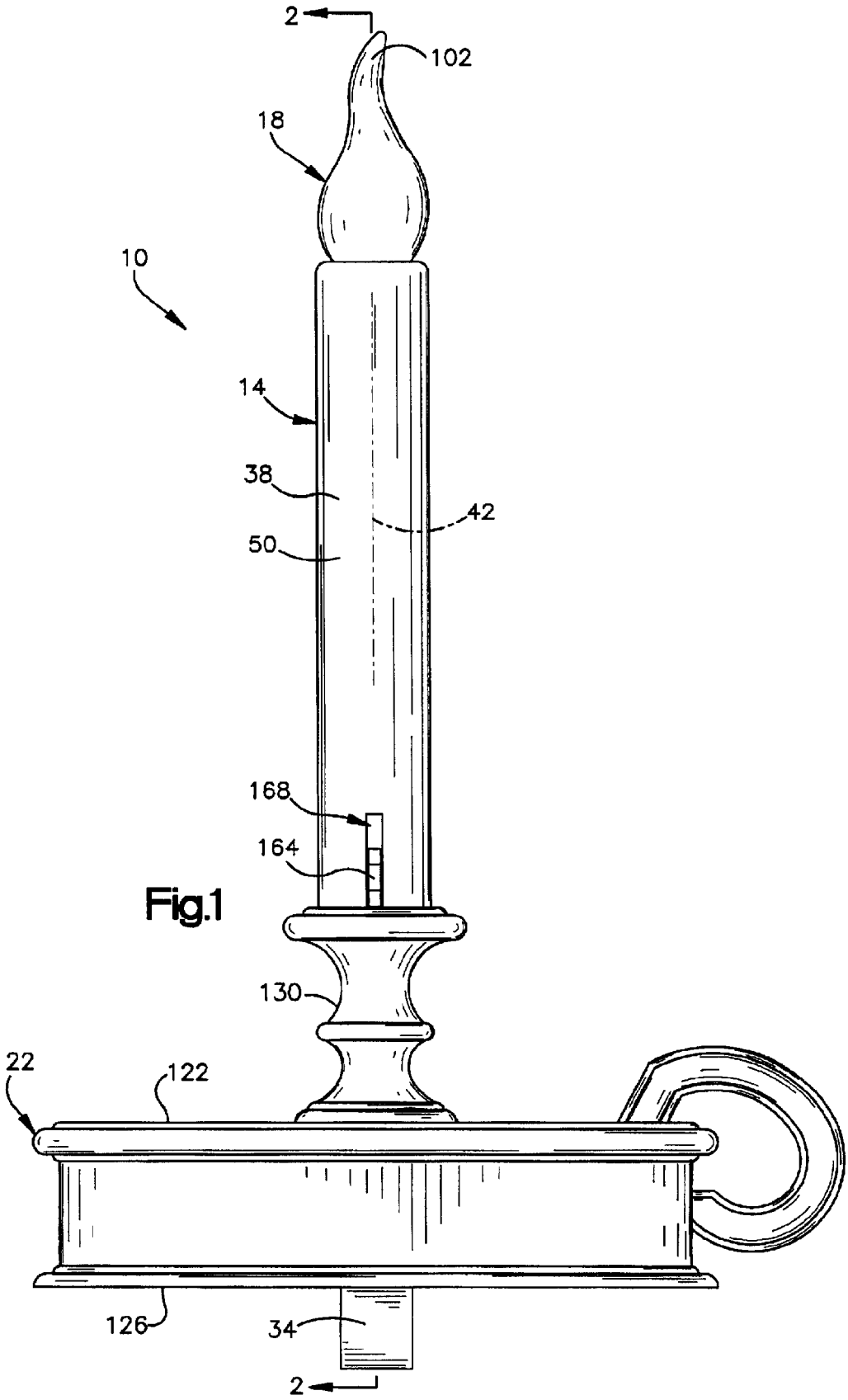
FIG. 1 is a side view of an apparatus comprising an embodiment of the invention.

The apparatus 10 shown in FIG. 1 has parts which, as described below, are examples of the elements recited in the claims.

The apparatus 10 is a vertically elongated, candle-shaped lamp structure configured to look like a wax candle with a candle holder. As shown in FIG. 1, the apparatus 10 includes a candlestick 14, a lamp cap 18, and a base 22. The candlestick 14 is a vertically elongated tube and has the appearance of a wax candlestick. The lamp cap 18 is flame-shaped and projects upward from the upper end of the candlestick 14 to simulate a burning candle flame. The base 22 is configured to support the candlestick 14 and the lamp cap 18 on a horizontal surface such as a windowsill 30 (FIG. 2). A removable clip 34 extends downward from the base 22 between the windowsill 30 and the window frame 36, as shown in FIG. 2. The clip 34 provides additional stability by anchoring the apparatus 10 to the windowsill 30.

The candlestick 14 has a translucent side wall 38 centered on an axis 42, as best shown in FIG. 2. The side wall 38 has cylindrical inner and outer wall surfaces 46 and 50, and an open lower end 54. A translucent upper end wall 58 projects radially inward from the side wall 38 and defines an aperture 61 centered on the axis 42.

Figure 2:
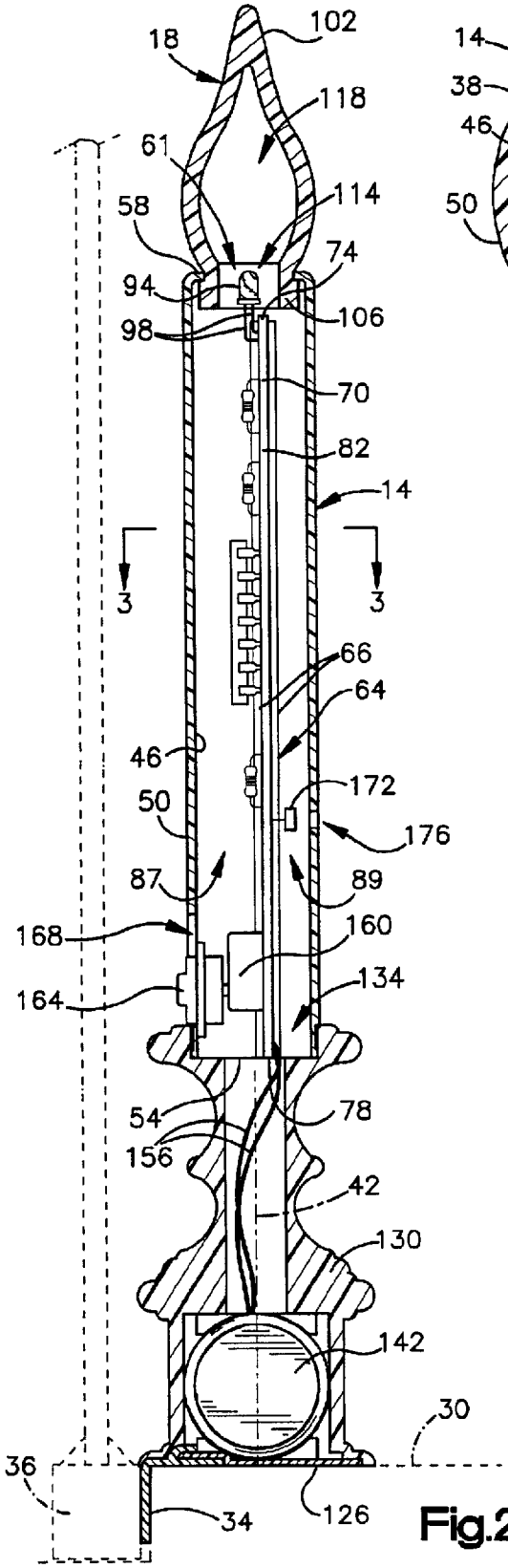
FIG. 2 is a view taken on line 2—2 of FIG. 1.
Figure 3:
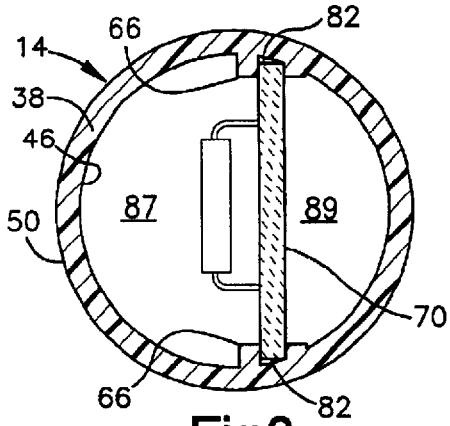
FIG. 3 is a view taken on line 3—3 of FIG. 2.

As shown in FIGS. 2 and 3, a pair of opposed guide structures 66 are located at the inner wall surface 46 of the candlestick 14. The guide structures 66 are configured to receive a circuit board 70. Each guide structure 66 extends axially along the inner wall surface 46 from the open lower end 54 nearly to the upper end wall 58.

As shown in FIG. 2, the circuit board 70 is vertically elongated and is received upward through the open lower end 54 of the candlestick 14. The circuit board 70 has upper and lower horizontal end edges 74 and 78 and opposite vertical side edges 82. The side edges 82 are received by the guide structures 66. In the first embodiment, the length of the side edges 82 is such that the circuit board 70 extends axially from the lower end 54 to the upper end wall 58 when positioned within the guide structures 66. The circuit board 70 thus divides the interior of the candlestick 14 into two nearly semi-cylindrical compartments 87 and 89.

A source of light 94 is electrically connected to the circuit board 70 by a pair of electrical leads 98. The source of light 94 preferably is a super bright light emitting diode (LED). When connected to the circuit board 70 as shown in FIG. 2, the source of light 94 is held in a position located above the upper end edge 74 of the circuit board 70 and centered on the axis 42. A different source of light, such as a bulb, could be used in place of the LED as long as the source of light permits light to travel in an unobstructed path upward from the aperture 61 in the upper end wall 58, and also downward into the compartments 87 and 89 on opposite sides of the circuit board 70.

The lamp cap 18 is configured to be received by the aperture 61 at the upper end wall 58 of the candlestick 14. The lamp cap 18 also is translucent and has a shape that simulates a candle flame. The lamp cap 18 has an upper end portion 102 with a conical tip and a lower end 106 portion shaped as an open collar defining a lamp cap aperture 114. The collar 106 is configured so that it can be inserted into the aperture 61 of the upper end wall 58 of the candlestick 14. The lamp cap aperture 114 is open to a conical cavity 118 within the lamp cap 18 as shown in FIG. 2.

As best shown in FIG. 1, the base 22 is horizontally elongated and has upper and lower base surfaces 122 and 126. The base 22 has a pedestal portion 130 that projects upward from the upper base surface 122. The pedestal portion 130 has an upper recess 134 (FIG. 2) configured to receive and support the lower end 54 of the candlestick 14. The lower base surface 126 is flat and configured to rest on a horizontal surface such as the windowsill 30.

Figure 5:
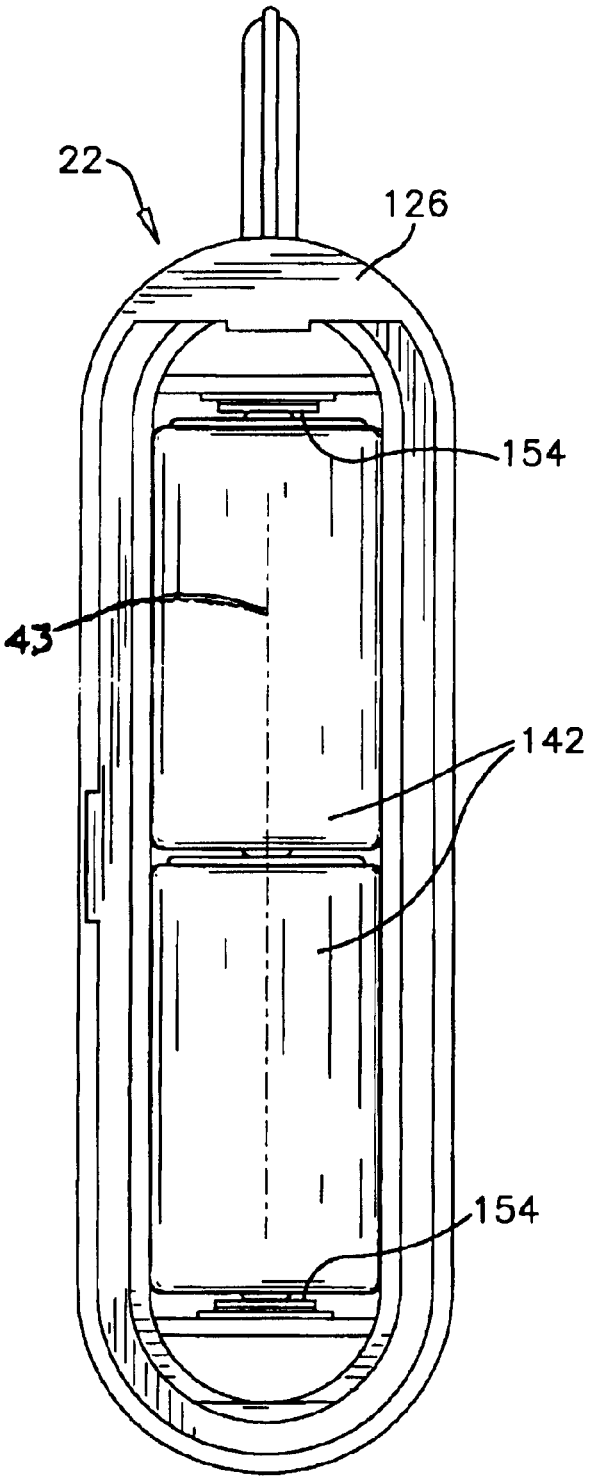
FIG. 5 is a view similar to FIG. 4, showing installed batteries.
Figure 6:
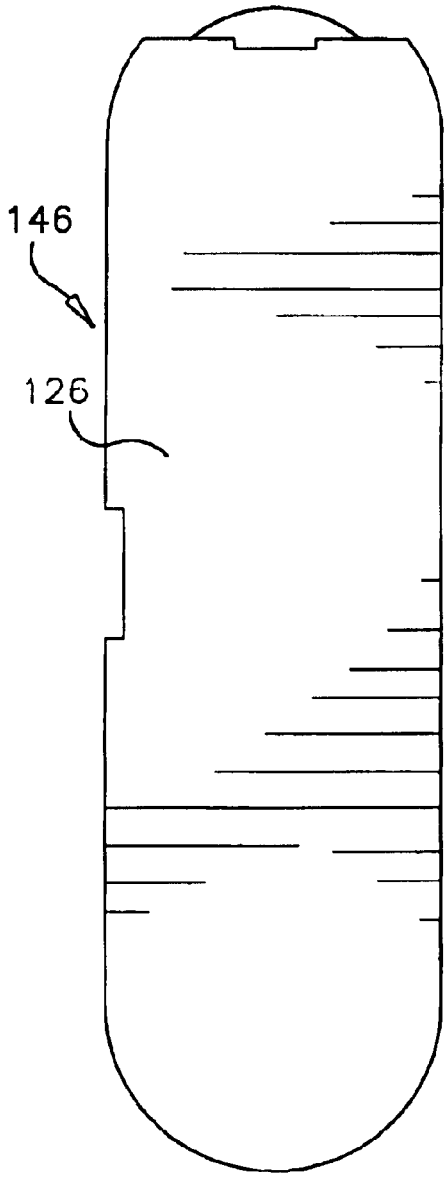
FIG. 6 is a bottom view of another part of the apparatus of FIG. 1.

As also shown in FIG. 5, the base 22 has a horizontal longitudinal central axis 43. The longitudinal central axis 43 of the base 22 is perpendicular to the vertical central axis 42 of the candlestick 14.

Figure 4:
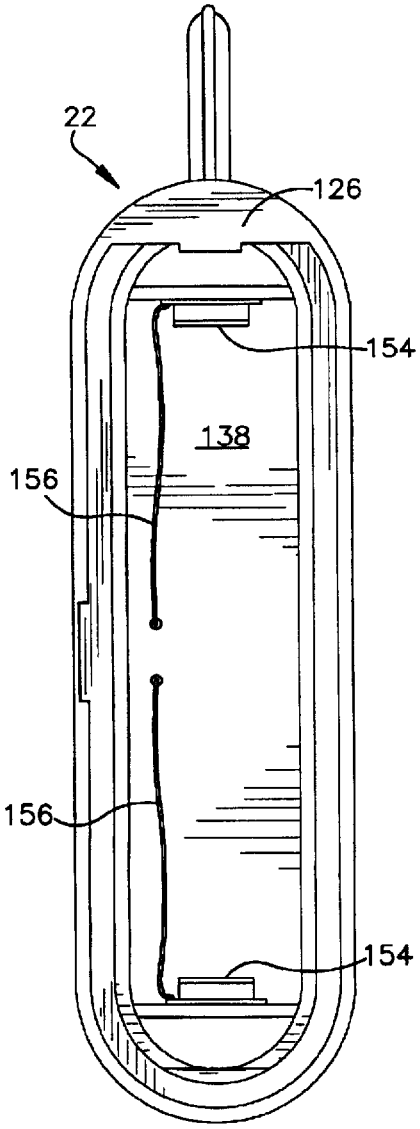
FIG. 4 is a bottom view of parts of the apparatus of FIG. 1.

The base 22 includes a pair of opposed electrical contacts 154 located at opposite ends of the battery compartment 138. The batteries 142 are inserted in a row in horizontal end-to-end positions between the contacts 154 as shown in FIG. 5. The contacts 154 are attached to a pair of electrical leads 156 (FIG. 4). As shown in FIG. 2, the leads 156 extend upward through the pedestal 130 and into the candlestick 14 where they attach to the circuit board 70.

The candlestick 14 and the lamp cap 18 are made from translucent materials. The orientation of the LED 94 and the circuit board 70 within the candlestick 14 are such that light from the LED 94 travels in an uninterrupted path into the semi-cylindrical compartments 87 and 89, and into the translucent lamp cap 18. This orientation results in a bright glow being emitted through the cap 18. The glow decreases in intensity as the light travels down toward the lower end 54 of the candlestick 14. Thus, the pattern of light emitted from the candlestick 14 simulates the look of a real wax candle in which the portion of the candle nearest the flame is observed to glow brighter than the lower portion of the candle.

The horizontally elongated configuration of the base 22 imparts stability to the apparatus 10 as does the orientation of the batteries 142 in the base 22. As mentioned above, the batteries 142 are held in a row in horizontal end-to-end positions as shown in FIG. 5. This end-to-end orientation distributes the weight of the batteries 142 in a horizontally lengthwise fashion within the base 22 to provide a low center of gravity, thereby increasing the stability of the apparatus 10. As shown in FIG. 2, the horizontal, end-to-end battery row configuration also permits the base 22 to have a narrow profile, so that a typical windowsill 30 can completely accommodate the width of the base 22 during display of the apparatus 10.

The circuit board 70 includes a flicker circuit. The flicker circuit uses an oscillator output to control the current to the source of light 94 to provide at least three distinct light levels that vary in a pseudo-random manner. The flicker circuit may have any suitable configuration known in the art. Use of the flicker circuit contributes to the realistic look of the apparatus 10 by simulating the natural changes in brightness exhibited by the flame of a burning candlewick.

A three way switch 160 is attached to the circuit board 70 as best shown in FIG. 2. The switch 160 has an actuator 164 that projects through a slot 168 in the side wall 38 of the candlestick 14. The switch 160 is used to place the source of light 94 in an "on" mode, an "off" mode, or a "flicker" mode. The function of the "on" mode is to supply the source of light 94 with an electric current that is constant and is greater than when the apparatus 10 is operating in the "flicker" mode. The "on" mode allows the apparatus 10 to be used as a normal lighting fixture whereas the "flicker" mode activates the flicker circuit described above to provide a more realistic candle look.

A light sensing device 172 also is attached to the circuit board 70, as shown in FIG. 2. A light hole 176 located in the side wall 38 of the candlestick 14 is positioned directly over the sensing device 172 to allow ambient light to strike the light sensor portion of the device 172. If the amount of ambient light striking the device 172 is above a certain preset threshold, then the device 172 turns the source of light 94 off to extend battery life. Power is restored to the apparatus 10 when the device 172 detects a sufficiently low level of ambient light.

This written description uses an example to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A lamp apparatus comprising:

a vertically elongated candlestick structure having a cylindrical side wall centered on an axis, said side wall having inner and outer wall surfaces and an open lower end, said candlestick structure further having an upper end wall which projects radially inward from said side wall and defines an aperture centered on said axis;

a pair of opposed guide structures at said inner wall surface, said guide structures being configured to receive a circuit board;

a vertically elongated circuit board received upward through said open lower end of said side wall, said circuit board having upper and lower horizontal end edges, and further having opposite vertical side edges received by said guide structures, said circuit board dividing the interior of said candlestick structure into two vertically elongated compartments on opposite sides of said circuit board; and a source of light electrically connected to said circuit board in a position located above said upper end edge and centered on said axis;

whereby light from said source has an uninterrupted path from said source upward through said aperture and downward through said compartments;

and further comprising a horizontally elongated oblong base configured to support said candlestick structure, said oblong base having a horizontal, longitudinal central axis perpendicular to said axis of said candlestick structure, said oblong base defining a horizontally elongated battery compartment configured to receive batteries in a row in end-to-end horizontal positions, said oblong base including battery contacts at opposite ends of said battery compartment.

2. An apparatus as defined in claim 1 wherein said oblong base has a pair of elongated parallel opposite side surfaces.

3. An apparatus as defined in claim 2 wherein said oblong base has arcuate end surfaces connecting said side surfaces.

* * * * *